US005564971A

United States Patent [19]

Evensen

[11] Patent Number: 5,564,971

[45] **Date of Patent: *Oct. 15, 1996**

[54] ROLLER AND BELT ASSEMBLY FOR SANDING AND BUFFING MACHINES

[76] Inventor: Kenneth Evensen, 820 Central, Roselle, Ill. 60172

[ * ] Notice: The term of this patent shall not extend beyond the expiration date of Pat. No. 5,567,197.

[21] Appl. No.: 324,806

[22] Filed: Oct. 18, 1994

[51] Int. Cl.[6] ..... B24D 9/02

[52] U.S. Cl. ..... 451/504; 451/495; 451/490; 451/508

[58] Field of Search ..... 451/344, 350, 451/352, 358, 490, 495, 504, 506, 507, 508, 509, 513, 514, 516, 526, 528, 538, 539

[56] References Cited

U.S. PATENT DOCUMENTS

| | | | |
|---|---|---|---|
| 1,325,937 | 12/1919 | Fox . | |
| 2,221,173 | 11/1940 | Gutsell | 451/506 |
| 2,483,422 | 10/1949 | Larson | 451/506 |
| 3,597,883 | 8/1971 | Choplin | 451/358 |
| 3,688,453 | 9/1972 | Legacy et al. | 51/400 |
| 3,790,980 | 2/1974 | Sylvie | 15/23 |
| 3,793,782 | 2/1974 | Bowling | 51/150 |
| 4,177,611 | 12/1979 | Carr-Rollett | 51/376 |
| 4,380,092 | 4/1983 | Brothers | 15/209 |
| 4,694,616 | 9/1987 | Lindberg | 51/170 |
| 5,007,208 | 4/1991 | Garfield | 51/281 |
| 5,380,239 | 1/1995 | Casillas et al. | 451/538 |

OTHER PUBLICATIONS

"Coated Abrasives—Modern Tool of Industry" by Coated Abrasives Manufacturer Institute, dated 1965; pp. 46–49, 72–77.

"Scotch–Brite and Roloc Surface Conditioning Discs" by 3M Company, 1988.

"Scotch–Brite Surface Conditioning Belts"by 3M Company, 1991, pp. 1–8.

"Scotch–Brite Surface Condtioning Products" by 3M Company, 1992, pp. 1–12.

*Primary Examiner*—D. S. Meislin
*Assistant Examiner*—Eileen P. Morgan
*Attorney, Agent, or Firm*—Fitch, Even, Tabin & Flannery

[57] ABSTRACT

The roller and belt assembly for mounting on a spindle or drive shaft comprises a closed loop belt having an inner surface and an outer surface, the inner surface having an engagable material thereon, and the outer surface having an abrasive or buffing material thereon. The assembly further includes a cylindrical roller having an outer cylindrical surface, having a longitudinal axis and having a resilient, compressible material attached to and covering the outer cylindrical surface. Sliding and engaging structure is attached to the resilient, compressible material which, when the belt is rotated in a first direction, allows the belt to slidingly rotate around and about the longitudinal axis of the roller and, when the belt is rotated in a second direction, the sliding and engaging structure engages the engagable material on the inner surface of the belt and prevents the belt from rotating about the roller.

19 Claims, 5 Drawing Sheets

ROLLER AND BELT ASSEMBLY FOR SANDING AND BUFFING MACHINES

BACKGROUND OF THE INVENTION

1. Field of the Invention

The present invention relates to a roller and belt assembly which is adapted for use with a spindle of a rotary sanding machine or a hand held drill and generally used for finishing wood or any other sandable or buffable surface.

2. Description of the Related Art Including Information Disclosed Under 37 CFR §§1.97–1.99

Heretofore, various assemblies have been proposed for attaching sandpaper to a spindle or roller to prevent slippage of the sandpaper off of the roller, including assemblies having hard rubber rollers or inflatable rollers. Several examples of such assemblies are disclosed in the following U.S. Patents:

| U.S. Pat. No. | Patentee |
|---|---|
| 5,007,208 | Garfield |
| 4,177,611 | Carr-Rollett |

The Garfield U.S. Pat. No. 5,007,208 discloses a method and apparatus for anchoring a sanding belt on a rotary sanding drum. Garfield places a strip of sandpaper on an outer surface of the drum which covers substantially, but not entirely, the outer surface of the drum. Garfield then places the sanding belt over the strip of sandpaper and drum. The strip of sandpaper eliminates the slack that would be present if the sanding belt is placed over the drum alone.

The Carr-Rollett U.S. Pat. No. 4,177,611 discloses a sanding and buffing attachment for power tools. The attachment includes a resilient base which is circular with an axial bore therethrough and which has an abrasive material, such as sandpaper, on an exterior of the base. Securing plates sandwich the base and have cooperating hollow spindle portions that engage each other and extend through the bore. Each plate also has prongs which extend into and engage the resilient base.

SUMMARY OF THE INVENTION

According to the present invention there is provided a roller and belt assembly for mounting on a spindle or drive shaft. The assembly comprises a closed loop belt having an inner surface and an outer surface, the inner surface having an engagable material thereon, and the outer surface having an abrasive or buffing material thereon. The assembly further includes a cylindrical roller having an outer cylindrical surface, having a longitudinal axis and having a resilient, compressible material attached to and covering the outer cylindrical surface. Sliding and engaging structure is attached to the resilient, compressible material which, when the belt is rotated in a first direction, allows the belt to slidingly rotate around and about the longitudinal axis of the roller and, when the belt is rotated in a second direction, the sliding and engaging structure engages the engagable material on the inner surface of the belt and prevents the belt from rotating about the roller.

DESCRIPTION OF THE PREFERRED EMBODIMENT(S)

Figure 1:
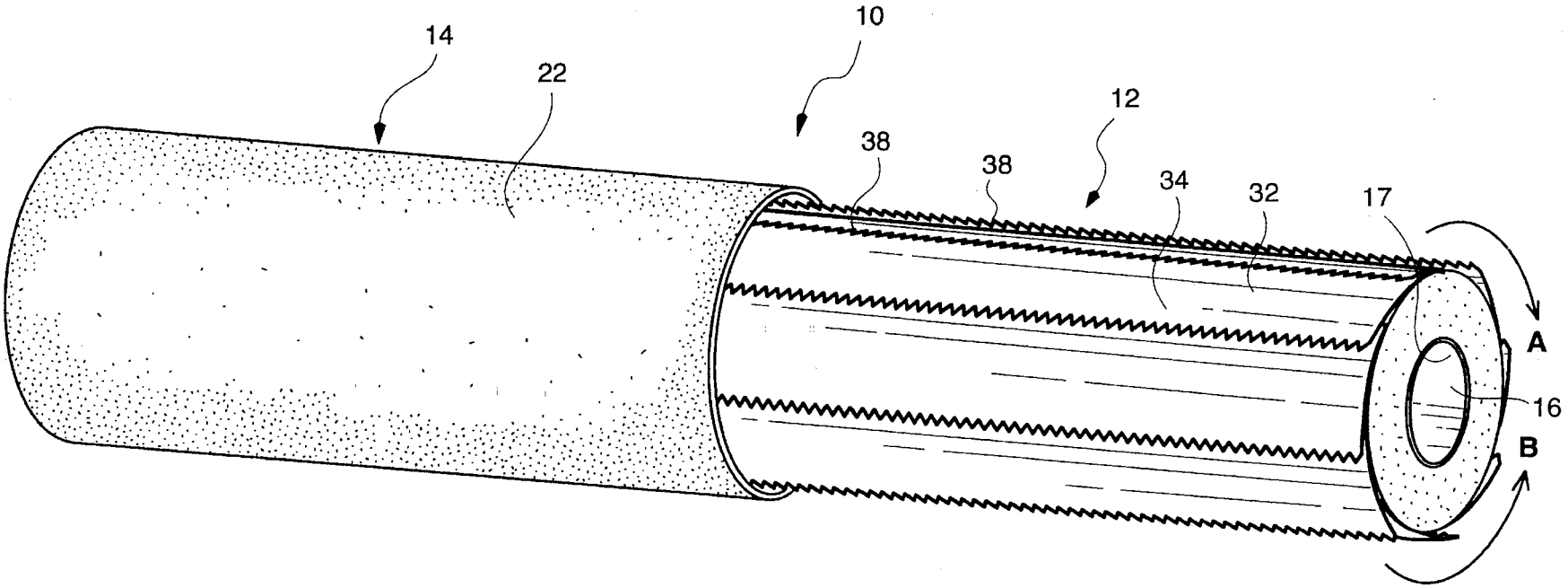
FIG. 1 is a perspective view of a partially assembled roller and belt assembly constructed according to the teachings of the present invention and shows a roller partially inserted into a closed loop sandpaper belt.

Referring now to FIG. 1, there is shown therein a partially assembled roller and belt assembly 10. The roller and belt assembly 10 includes a cylindrical roller 12 and a closed loop belt 14. The cylindrical roller 12 can be inserted within the closed loop belt 14 and, as shown in FIGS. 4, 5, 6 and 7, the roller 12 can be fully inserted within the belt 14.

Figure 7:
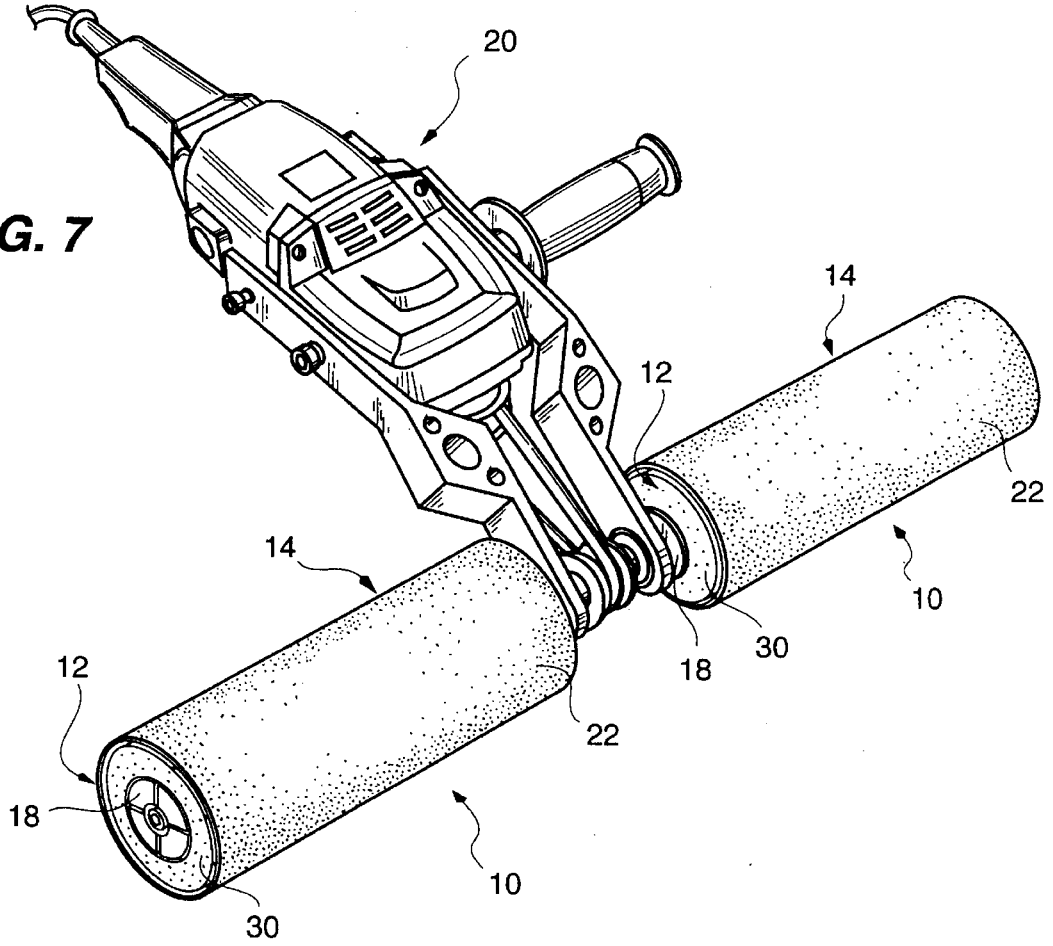
FIG. 7 is perspective view of a roller and belt assembly mounted on a roller type sanding or buffing machine.

The cylindrical roller 12 includes an inner cylindrical tube 16, having a smooth inner surface 17. The inner surface 17 of the roller 12 allows the roller 12 to be mounted longitudinally on a rotating member 18 of a roller buffer machine 20 (FIG. 7).

Figure 2:
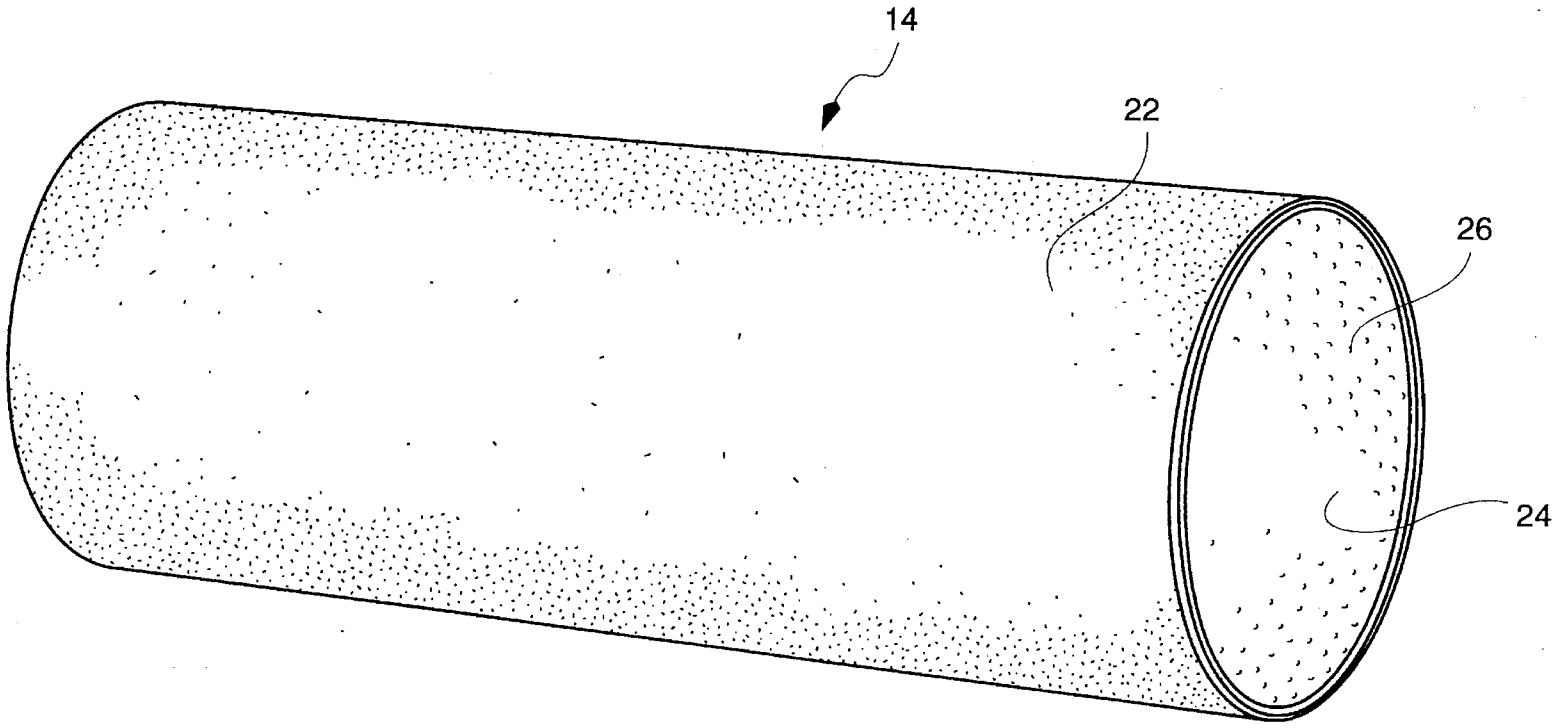
FIG. 2 is a perspective view of the closed loop sandpaper belt shown in FIG. 1.

Referring now to FIG. 2, the closed loop belt 14 has an outer surface 22 and an inner surface 24. The outer surface 22 of the belt 14, as illustrated, has sandpaper thereon. Note, however, that the outer surface 22 of the belt 14 can have any suitable abrasive or buffing material thereon, e.g., a non-woven abrasive material such as one sold under the trademark SCOTCH-BRITE™, steel wool, cloth or foam material, which is used for finishing wood or any other sandable or buffable surface.

The inner surface 24 of the belt 14 has a coarse, looped material 26 thereon. The coarse, looped material 26 can be a polyester material such as sewing fleece or a looped material similar to that used in a hook and loop type fastener assembly such as the assemblies sold under the trademark VELCRO™.

Figure 3:
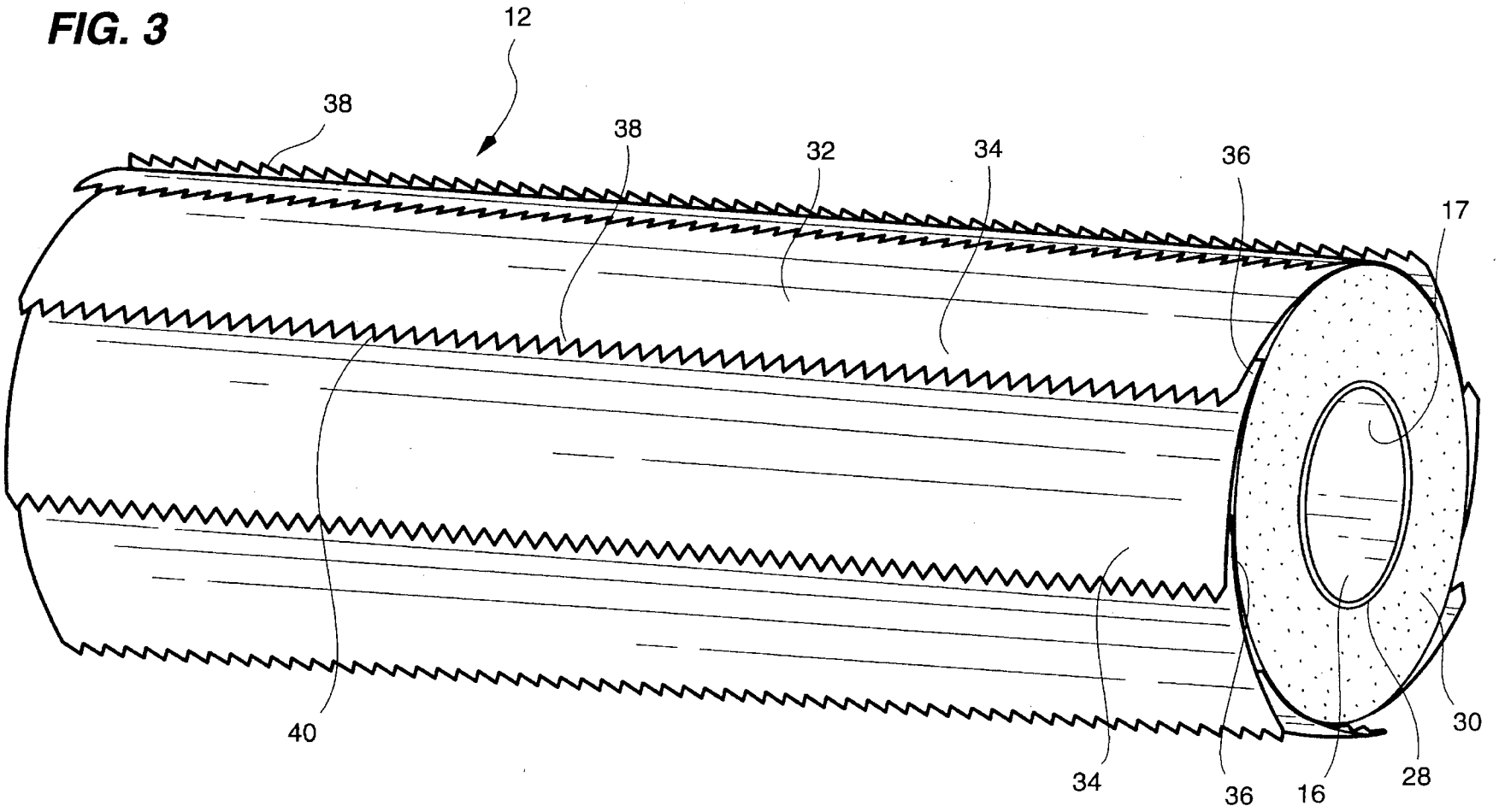
FIG. 3 is a perspective view of the roller shown in FIG. 1.

The cylindrical tube 16, shown in FIG. 3 is made of a rigid material, such as metal, plastic or cardboard so that the cylindrical tube 16 can be mounted to a rotating member 18 of a roller buffing machine (shown in FIG. 7), a spindle sander (not shown) or a hand held drill (not shown).

The cylindrical tube 16 has an outer surface 28 which has a compressible, resilient material 30 thereon. The compressible, resilient material 30 preferably is a foam material 30 and is attached to the outer surface 28 of the cylindrical tube 16 by an adhesive. The foam material 30 may also be extruded integrally with the tube 16.

Figure 5:
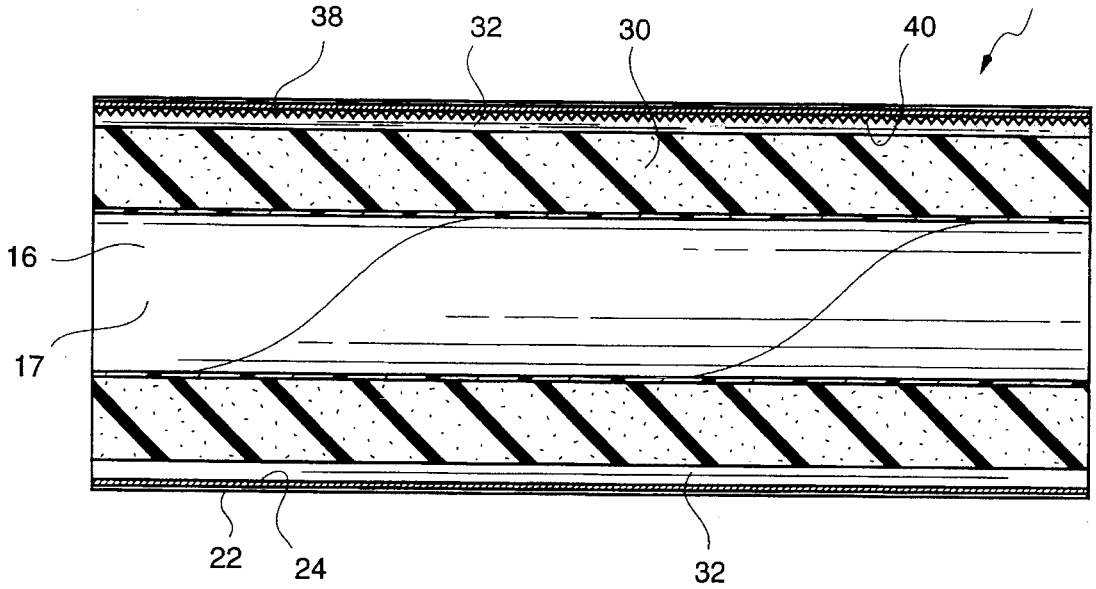
FIG. 5 is a bottom sectional view of the roller and belt assembly and is taken along the line 5—5 of FIG. 4.
Figure 6:
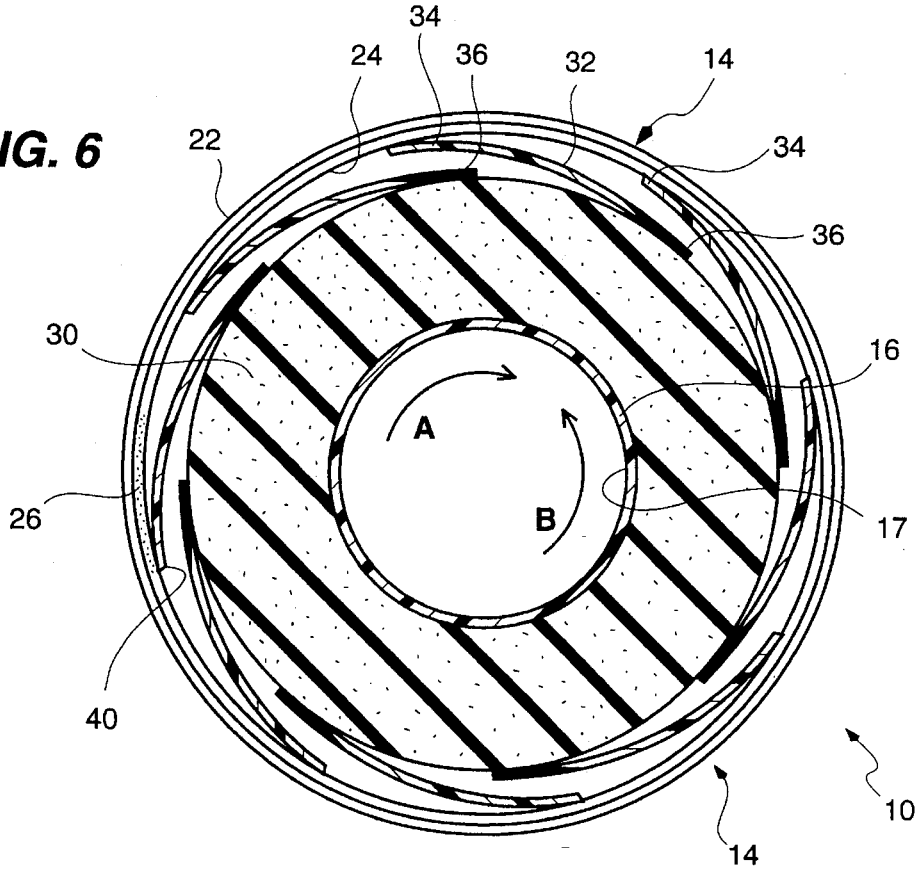
FIG. 6 is a side sectional view of the roller and belt assembly taken along the line 6—6 of FIG. 4.

As shown in FIGS. 3, 5 and 6, several flexible engagement strips 32, preferably made of plastic, are attached to the foam material 30. The engagement strips 32 have a front end or edge 34 and a back end or edge 36. The back end 36 of each engagement strip 32 is attached to the foam material 30 by an adhesive, such as glue or tape.

The front end 34 of each engagement strip 32 is free, i.e. not attached to the foam material 30. Additionally, the front end 34 of each engagement strip 32 is serrated to form teeth 38 which are cut into a front end edge 40 of the strip 32.

As best shown in FIG. 6, the engagement strips 32 are flexible so that the strips 32 can be resiliently bent to conform to a circumference of the foam material 30 and the tube 16. The attached strips 32 are preferably positioned on the foam material 30 so that when the strips 32 are bent to conform to the shape of the foam material 30 and tube 16, the loose front end 34 of each engagement strip 32 overlaps the attached back end 36 of the engagement strip 32 just in front of it. Also, a sufficient number of engagement strips 32 are used so that when the foam material 30 is compressed, the engagement strips 32 completely cover the foam material 30 in the described overlapping manner.

The diameter of the uncompressed roller 12, including the diameter of the tube 16, the thickness of the uncompressed foam material 30 on the tube 16 and the thickness of the overlapped plastic strips 32 attached to the foam material 30 on the tube 16, is slightly larger than an inner diameter of the belt 14.

Therefore, in order to insert the roller 12 into the belt 14, the foam material 30 of the roller 12 must be compressed and the roller 12 must be simultaneously pushed into the belt 14 and rotated in a first direction, with respect to the belt 14, as shown by an arrow A in FIGS. 1 and 6, such that the teeth 38 of the plastic strips 32 will not engage the looped material 26 on the inner surface 24 of the belt 14. When the roller 12 is rotated in direction A, the plastic strips 32 of the roller 12 easily slide along the looped material 26 and the roller is easily inserted into the belt 14. The direction of rotation of the roller 12 in the first direction A, as shown in FIG. 6, is clockwise with respect to the belt 14.

Figure 4:
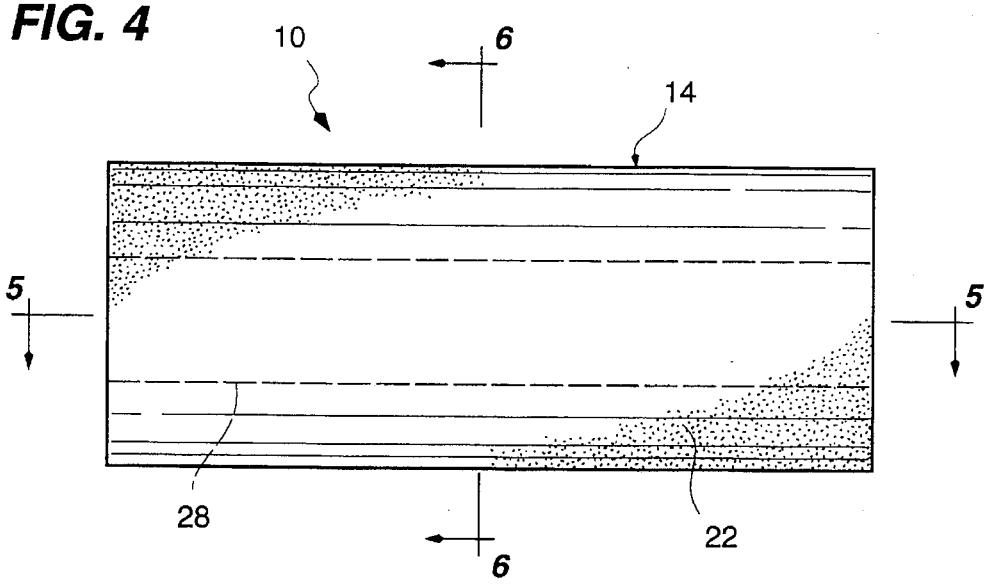
FIG. 4 is a front view of a roller fully inserted into a sandpaper belt to form an assembled roller and belt assembly.

Referring now to FIGS. 4, 5 and 6, once the roller 12 is inserted into the belt 14, the foam material 30 and strips 32 are allowed to expand within the belt 14. Although the foam material 30 expands to fit tightly within the belt 14, the foam material 30 and plastic strips 32 are constrained by the belt 14 and cannot expand completely to their original shapes. Because the foam material 30 is still constrained by the continuous belt 14, the foam material 30 applies an even, radially outwardly directed, radial force against the inner surface 24 of the belt 14.

As best illustrated in FIG. 6, when the roller 12 is inserted into the belt 14, the teeth 38 of the bent plastic strips 32 all point in the same direction along the circumference of the roller 12 such that the teeth 38 will engage the looped material 26 if the roller 12 is rotated in a second direction, B, as shown by an arrow in FIGS. 1 and 6. Note that the second direction, B, is opposite the first direction, A, and, as shown in FIG. 6, is in the counterclockwise direction with respect to the belt 14.

When the roller 12 is completely inserted within the belt 14, the roller 12 and belt 14 form an assembled roller and belt assembly 10 and, as previously described above, the assembled roller and belt assembly 10 can be attached to a rotating member 18 of a roller buffing machine (FIG. 7), a spindle sander or a hand held drill.

When the roller and belt assembly 10 is used to sand or buff an object, the assembled roller and belt assembly 10 must be attached to the rotating member 18 so that the roller 12 will be driven or rotated in the second direction, B, to ensure that the teeth 38 will engage the looped material 26 and thereby rotate the belt 14 without causing the belt 14 to slip or creep off of the roller 12.

After substantial use, a worn belt 14 can be removed from the roller 12 easily and replaced by a new belt 14. First, the roller and belt assembly 10 must be removed from the rotating member 18. Then, the worn belt 14 is removed from the roller 12 by simultaneously rotating the roller 12 in the first direction, A, so that the teeth 38 do not engage the looped material 26 and pushing the roller 12 out of the belt 14. Then, a new belt 14 can be placed on the roller 12 in the same manner described above.

Although the roller and belt assembly 10 is shown in FIG. 7 is adapted to be mounted on an aluminum rotating member 18 of a rotary buffer, such as the rotary buffer disclosed in U.S. Ser. No. 08/168,042, applicant points out that the roller and belt assembly 10 of the present invention can be mounted onto any suitable rotating member, such as a spindle of a spindle sander or a hand held drill.

From the foregoing description, it will be apparent that the roller and belt assembly of the present invention has a number of advantages, some of which have been described above and others of which are inherent in the invention. Also it will be understood that modifications can be made to the roller and belt assembly described above without departing from the teachings of the present invention. Accordingly, the scope of the invention is only to be limited as necessitated by the accompanying claims.

I claim:

1. A roller and belt assembly for mounting on a spindle or drive shaft, comprising:

a closed loop belt having an inner surface and an outer surface, said inner surface having an engageable material thereon, and said outer surface having an abrasive or buffing material thereon;

a cylindrical roller having an outer cylindrical surface, having a longitudinal axis and having a resilient, compressible material attached to and covering said outer cylindrical surface;

sliding and engaging means disposed between the cylindrical roller compressible material and the closed loop belt to allow the closed loop belt to easily slide and to rotate relative to the cylindrical roller in an opposite direction to a sanding direction of rotation to aid in installation or removal of a closed loop belt on the cylindrical roller and to positively engage the closed loop belt in the sanding direction without relative rotation between the closed loop sleeve and the cylindrical roller; and the sliding and engaging means including low friction surfaces that allow easy sliding of the closed loop belt relative to the cylindrical roller with rotation in the opposite direction during an installation or removal of the closed loop belt.

2. The roller and belt assembly of claim 1 wherein said engagable material is sewing fleece.

3. The roller and belt assembly of claim 1 wherein said engagable material is a looped material such as the looped material used in a hook and loop fastener assembly sold under the trademark VELCRO™.

4. The roller and belt assembly of claim 1 wherein said compressible resilient material is a foam material.

5. The roller and belt assembly of claim 1 wherein said abrasive or buffing material is sandpaper.

6. The roller and belt assembly of claim 1 wherein said abrasive or buffing material is a non-woven abrasive material such as one sold under the trademark SCOTCH-BRITE™.

7. The roller and belt assembly of claim 1 wherein said roller includes a tube and an outer diameter of said roller, including the diameter of said tube, the resilient material and the sliding and engaging means, in an uncompressed position is slightly larger than an inner diameter of the closed loop belt.

8. The roller and belt assembly of claim 1 wherein said roller includes a tube and an outer diameter of said roller, including the diameter of said tube, the resilient material and the sliding and engaging means, in a compressed position is slightly smaller than an inner diameter of the closed loop belt.

9. A roller and belt assembly in accordance with claim 1 wherein plastic strips of flexible material have said low friction surfaces thereon; and teeth on said plastic strips are engaged with the engageable material on the closed loop belt to turn the cylindrical roller in the sanding direction.

10. A roller and belt assembly in accordance with claim 9 wherein the plastic strips are attached to the compressible material of the roller and are resiliently bent to conform to the cylindrical surface of the roller.

11. A roller and belt assembly for mounting on a spindle or drive shaft, comprising:

a closed loop belt having an inner surface and an outer surface, said inner surface having an engageable material thereon, and said outer surface having an abrasive or buffing material thereon;

a cylindrical roller having an outer cylindrical surface, having a longitudinal axis and having a resilient, compressible material attached to and covering said outer cylindrical surface;

sliding and engaging means attached to said resilient, compressible material which, when said belt is rotated in a first direction, allows said belt to slidingly rotate around and about said longitudinal axis of said roller and, when said belt is rotated in a second direction, said sliding and engaging means engages said engageable material on said inner surface of said belt and prevent said belt from rotating about said roller;

said sliding and engaging means including at least two plastic strips each having a front end and a back end, said front ends each having teeth and said back ends each being attached to said resilient material; and said strips are positioned one in front of the other and cover the entire circumference of the resilient material such that said front end of a first strip overlaps the back end of a second strip which is positioned directly in front of said first strip.

12. A roller and belt assembly for mounting on a spindle or drive shaft, comprising:

a closed loop belt having an inner surface and an outer surface, said inner surface having an engageable material thereon, and said outer surface having an abrasive or buffing material thereon;

a cylindrical roller having an outer cylindrical surface, having a longitudinal axis and having a resilient, compressible material attached to and covering said outer cylindrical surface:

sliding and engaging means attached to said resilient, compressible material which, when said belt is rotated in a first direction, allows said belt to slidingly rotate around and about said longitudinal axis of said roller and, when said belt is rotated in a second direction, said sliding and engaging means engages said engageable material on said inner surface of said belt and prevents said belt from rotating about said roller; and said sliding and engaging means including at least one strip of plastic having a front end and a rear end, said rear end being attached to said resilient compressible material and said front end having teeth thereon.

13. The roller and belt assembly of claim 12 wherein said strip is attached parallel to said longitudinal axis of said roller.

14. A roller, for use with a closed loop belt having an inner surface containing an engageable material and an outer surface having sandpaper or other abrasive material thereon, comprising:

a cylindrical inner tube having an outer cylindrical surface, and having a resilient, compressible material covering said outer cylindrical surface;

sliding and gripping means attached to said resilient, compressible material which, when said belt is rotated in a first direction, allows said belt to slidingly rotate about the longitudinal axis of said roller and, when said belt is rotated in a second direction, said sliding and engaging means engages said engageable material on said inner surface of said belt and prevents said belt from rotating about said roller;

said sliding and engaging means including at least one plastic strip having a front end and a back end, said back end of said plastic strip being attached to said roller; and said front end of said plastic strip having a serrated front edge which forms teeth which are pointed such that the teeth do not engage the engageable material when the roller is rotated within the belt in a first direction but engage the engageable material when rotated in a second direction opposite the first direction.

15. A cylindrical sleeve for detachably mounting on a rotatable roller for providing a one-way clutch connection with the sleeve, wherein the roller has a clutch portion, having teeth pointing in the second direction, said cylindrical sleeve comprising:

a closed loop sleeve having a substantially cylindrical shape;

an outer surface on the cylindrically-shaped sleeve having an abrasive or buffing material thereon;

a one-way clutch material on an inner surface of the sleeve having a driving connection with a clutch portion on the roller when rotating in a sanding or buffing direction and a releasable, slipping connection with the clutch portion when rotated in the opposite direction to allow telescoping and rotation of the sleeve onto or from the roller; and the one-way clutch material on the sleeve is a looped material to engage the one-way teeth when rotated relative thereto in the driving direction.

16. A cylindrical belt in accordance with claim 15 wherein the inner surface is a sewing fleece.

17. A cylindrical belt in accordance with claim 15 wherein the looped material is a loop fastener material sold under the trademark VELCRO or HOOK AND LOOP.

18. A cylindrical belt in accordance with claim 15 wherein the abrasive material is a sandpaper.

19. A cylindrical belt in accordance with claim 15 wherein the abrasive material is a non-woven abrasive material sold under the trademark SCOTCH-BRITE.

* * * * *

UNITED STATES PATENT AND TRADEMARK OFFICE

CERTIFICATE OF CORRECTION

PATENT NO. :5,564,971

DATED :October 15, 1996

INVENTOR(S) :Kenneth Evensen.

It is certified that error appears in the above-indentified patent and that said Letters Patent is hereby corrected as shown below:

Column 5, line 32, after "and", change "prevent" to --prevents--.

Column 5, line 53, change ":" (colon) to --;-- (semicolon).

Signed and Sealed this

Seventeenth Day of December, 1996

*Attest:*

Bruce Lehman

BRUCE LEHMAN

*Attesting Officer*

*Commissioner of Patents and Trademarks*